US011467511B2

(12) United States Patent
Hata

(10) Patent No.: US 11,467,511 B2
(45) Date of Patent: Oct. 11, 2022

(54) TECHNIQUE FOR ADJUSTING DEVELOPMENT VOLTAGE IN DEVELOPING DEVICE PROVIDED IN IMAGE FORMING APPARATUS

(71) Applicant: CANON KABUSHIKI KAISHA, Tokyo (JP)

(72) Inventor: Takayuki Hata, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/354,349

(22) Filed: Jun. 22, 2021

(65) Prior Publication Data

US 2022/0026843 A1 Jan. 27, 2022

(30) Foreign Application Priority Data

Jul. 27, 2020 (JP) ..... JP2020-126727

(51) Int. Cl.
*G03G 15/00* (2006.01)
*G03G 15/06* (2006.01)
*G03G 15/08* (2006.01)

(52) U.S. Cl.
CPC ..... *G03G 15/065* (2013.01); *G03G 15/5004* (2013.01); *G03G 15/80* (2013.01); *G03G 15/0863* (2013.01)

(58) Field of Classification Search
CPC ... G03G 15/80; G03G 15/065; G03G 15/5004
USPC ..... 399/55, 88, 285
See application file for complete search history.

(56) References Cited

U.S. PATENT DOCUMENTS 5,567,997 A * 10/1996 Suzuki ..... G03G 15/80 363/21.01
8,634,734 B2 1/2014 Okumura
2004/0018025 A1* 1/2004 Park ..... G03G 15/065 399/55
2009/0087205 A1* 4/2009 Naruge ..... G03G 15/0907 399/55
2013/0070484 A1* 3/2013 Mukaihara ..... H02M 1/36 363/21.1
2013/0322899 A1* 12/2013 Okada ..... G03G 15/065 399/55
2020/0366085 A1 11/2020 Hata

FOREIGN PATENT DOCUMENTS

JP 2012-63714 A 3/2012

* cited by examiner

*Primary Examiner* — Robert B Beatty
(74) *Attorney, Agent, or Firm* — Venable LLP

(57) ABSTRACT

An image forming apparatus controls a power supply circuit by supplying a control signal to the power supply circuit, and detects an electrical characteristic, e.g. an electrostatic capacitance generated between an image carrier and a developing member or a current caused to run by applying a development voltage to the developing member. The apparatus determines a change pattern of a duty ratio of a PWM signal including the control signal on the basis of the electrical characteristic. The apparatus changes the duty ratio as time passes according to the determined change pattern and outputs the control signal to the power supply circuit.

19 Claims, 11 Drawing Sheets

FIG. 6

| ELECTROSTATIC CAPACITANCE [pF] | | DUTY RATIO [%] | | | | | | | | | | | | | | | | | | | |
|---|---|---|---|---|---|---|---|---|---|---|---|---|---|---|---|---|---|---|---|---|---|
| | SECTION | 1 | 2 | 3 | 4 | 5 | 6 | 7 | 8 | 9 | 10 | 11 | 12 | 13 | 14 | 15 | 16 | 17 | 18 | 19 | 20 |
| CL < 170 | Aclk1 | 89 | 92 | 95 | 99 | 100 | 100 | 100 | 100 | 100 | 100 | 0 | 0 | 0 | 0 | 0 | 0 | 0 | 0 | 0 | 0 |
| | Aclk2 | 0 | 0 | 0 | 0 | 0 | 0 | 0 | 0 | 0 | 0 | 89 | 92 | 95 | 99 | 100 | 100 | 100 | 100 | 100 | 100 |
| 170 =< CL < 200 | Aclk1 | 90 | 93 | 96 | 99 | 100 | 100 | 100 | 100 | 100 | 100 | 0 | 0 | 0 | 0 | 0 | 0 | 0 | 0 | 0 | 0 |
| | Aclk2 | 0 | 0 | 0 | 0 | 0 | 0 | 0 | 0 | 0 | 0 | 90 | 93 | 96 | 99 | 100 | 100 | 100 | 100 | 100 | 100 |
| 200 =< CL < 230 | Aclk1 | 91 | 94 | 97 | 99 | 100 | 100 | 100 | 100 | 100 | 100 | 0 | 0 | 0 | 0 | 0 | 0 | 0 | 0 | 0 | 0 |
| | Aclk2 | 0 | 0 | 0 | 0 | 0 | 0 | 0 | 0 | 0 | 0 | 91 | 94 | 97 | 99 | 100 | 100 | 100 | 100 | 100 | 100 |

TECHNIQUE FOR ADJUSTING DEVELOPMENT VOLTAGE IN DEVELOPING DEVICE PROVIDED IN IMAGE FORMING APPARATUS

BACKGROUND OF THE INVENTION

Field of the Invention

The present invention relates to a technique for adjusting the development voltage in a developing device provided in an image forming apparatus.

Description of the Related Art

An electrophotographic developing device adheres toner on an electrostatic latent image by applying a development voltage in which an alternating current and a direct current are superimposed to a developing sleeve opposing a photosensitive member. When waveform distortion of the development voltage occurs, the electrostatic latent image may be damaged or an unintended leak current may be produced.

According to U.S. Pat. No. 8,634,734, when a waveform distortion is detected, a drive signal applied to a transformer is adjusted to reduce the waveform distortion. Specifically, the drive signal on a time axis is divided into three sections, a first ON period, an OFF period, and a second ON period, and the ratio of the three sections are adjusted to reduce the waveform distortion.

In U.S. Pat. No. 8,634,734, after the first ON period is adjusted on the basis of a waveform measurement result, the OFF period and the second ON period must be adjusted. Thus, processing for two adjustments is required, which requires a not insignificant amount of adjustment time.

SUMMARY OF THE INVENTION

An embodiment of the present invention may provide an image forming apparatus, comprising: an image carrier on which an electrostatic latent image is formed; a developing member disposed opposing the image carrier with a gap inbetween; a power supply circuit that applies, to the developing member, a development voltage that adheres a developing agent carried on the developing member to the electrostatic latent image; a processor that controls the power supply circuit by supplying a control signal to the power supply circuit; and a detection circuit that detects an electrical characteristic, which is an electrostatic capacitance generated between the image carrier and the developing member caused by the gap or a current caused to run by applying the development voltage to the developing member, the control signal including a PWM signal of which period is a predetermined period, wherein the processor is configured to determine a change pattern of a duty ratio of the PWM signal on the basis of the electrical characteristic detected by the detection circuit and change the duty ratio as time passes according to the determined change pattern and outputs the control signal to the power supply circuit.

Further features of the present invention will become apparent from the following description of exemplary embodiments (with reference to the attached drawings).

BRIEF DESCRIPTION OF THE DRAWINGS

FIG. 6 is a diagram illustrating an example of a control table.

DESCRIPTION OF THE EMBODIMENTS

Figure 1:
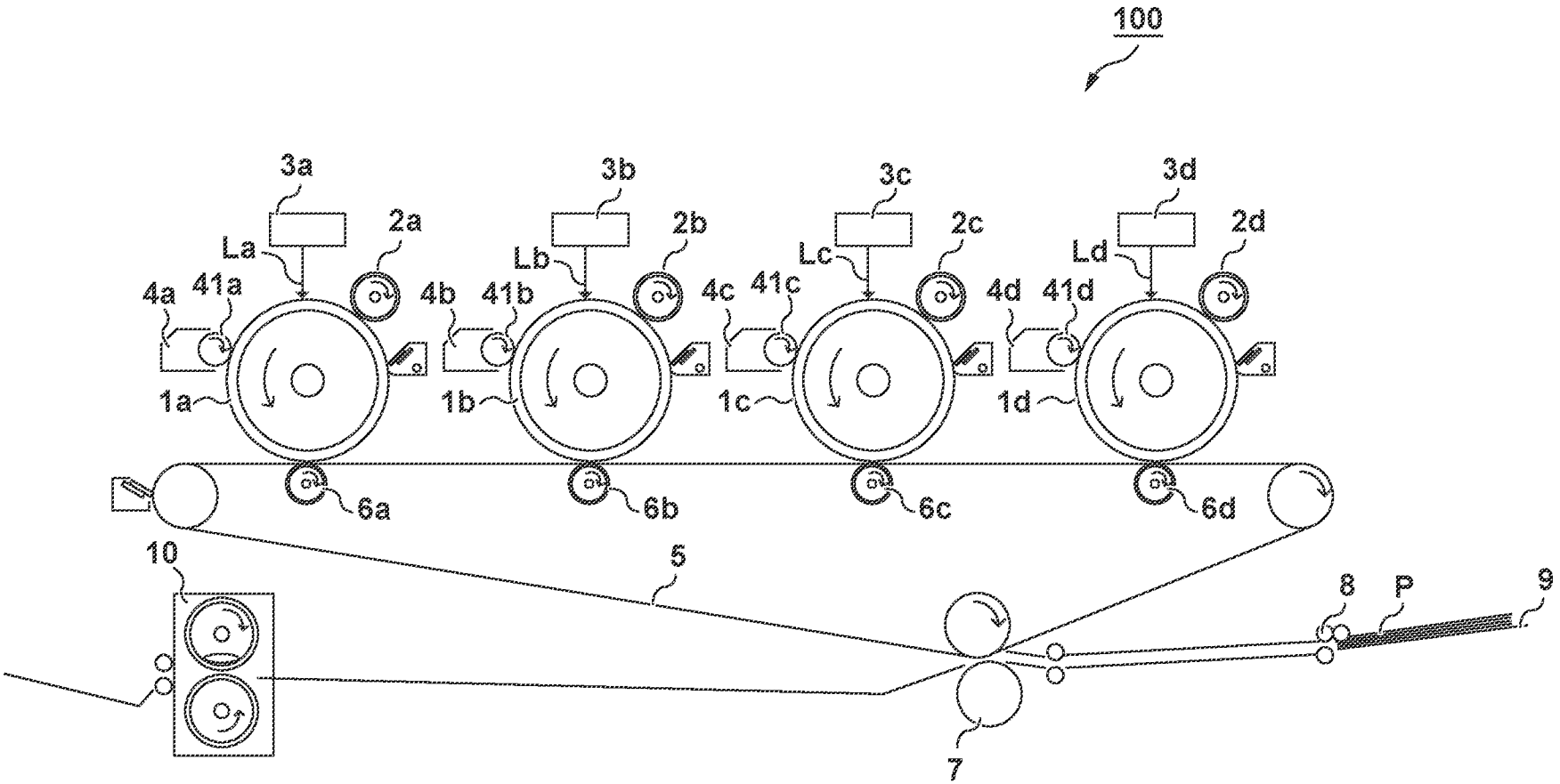
FIG. 1 is a diagram for describing an image forming apparatus.

Hereinafter, embodiments will be described in detail with reference to the attached drawings. Note, the following embodiments are not intended to limit the scope of the claimed invention. Multiple features are described in the embodiments, but limitation is not made an invention that requires all such features, and multiple such features may be combined as appropriate. Furthermore, in the attached drawings, the same reference numerals are given to the same or similar configurations, and redundant description thereof is omitted.

Image Forming Apparatus

As illustrated in FIG. 1, an image forming apparatus 100 forms an image on a sheet P via electrophotography. The image forming apparatus 100 may be a printer, a copy machine, a multi-function peripheral, or a facsimile machine. The image forming apparatus 100 is capable of forming full color images, however, the technical concept of the present invention may be applied to an image forming apparatus that forms monochrome images.

The image forming apparatus 100 includes four image forming stations for forming images of many colors using toners of four colors, yellow, magenta, cyan, and black. The characters a to d attached to the end of a reference number indicate yellow, magenta, cyan, and black. Note that the image forming stations all share the same configuration, and thus, in the following description, the characters a to d are omitted.

A photosensitive drum 1 is a drum-shaped image carrier. A charging roller 2 is a charging unit that uniformly charges the surface of the photosensitive drum 1. An exposure apparatus 3 is an exposure unit or an image forming unit that irradiates the surface of the uniformly-charged photosensitive drum 1 with a laser beam L based on image information and forms an electrostatic latent image. A developing device 4 is a developing unit that forms a toner image by adhering (developing) the toner carried by a developing sleeve 41 to the electrostatic latent image. A high-voltage development voltage for promoting development is applied to the developing sleeve 41. A primary transfer roller 6 is a transfer unit that transfers a toner image carried by the photosensitive drum 1 to an intermediate transfer belt 5. A feed cassette 9 houses a plurality of sheets P. A feeding roller 8 feeds the sheet P from the feed cassette 9 to a secondary transfer roller 7. The secondary transfer roller 7 is a transfer unit that transfers a toner image carried by the intermediate transfer belt 5 to the sheet P. A fixing device 10 is a fixing unit that fixes the toner image to the sheet P by applying heat and pressure to the toner image transferred onto the sheet P.

Controller

Figure 2:
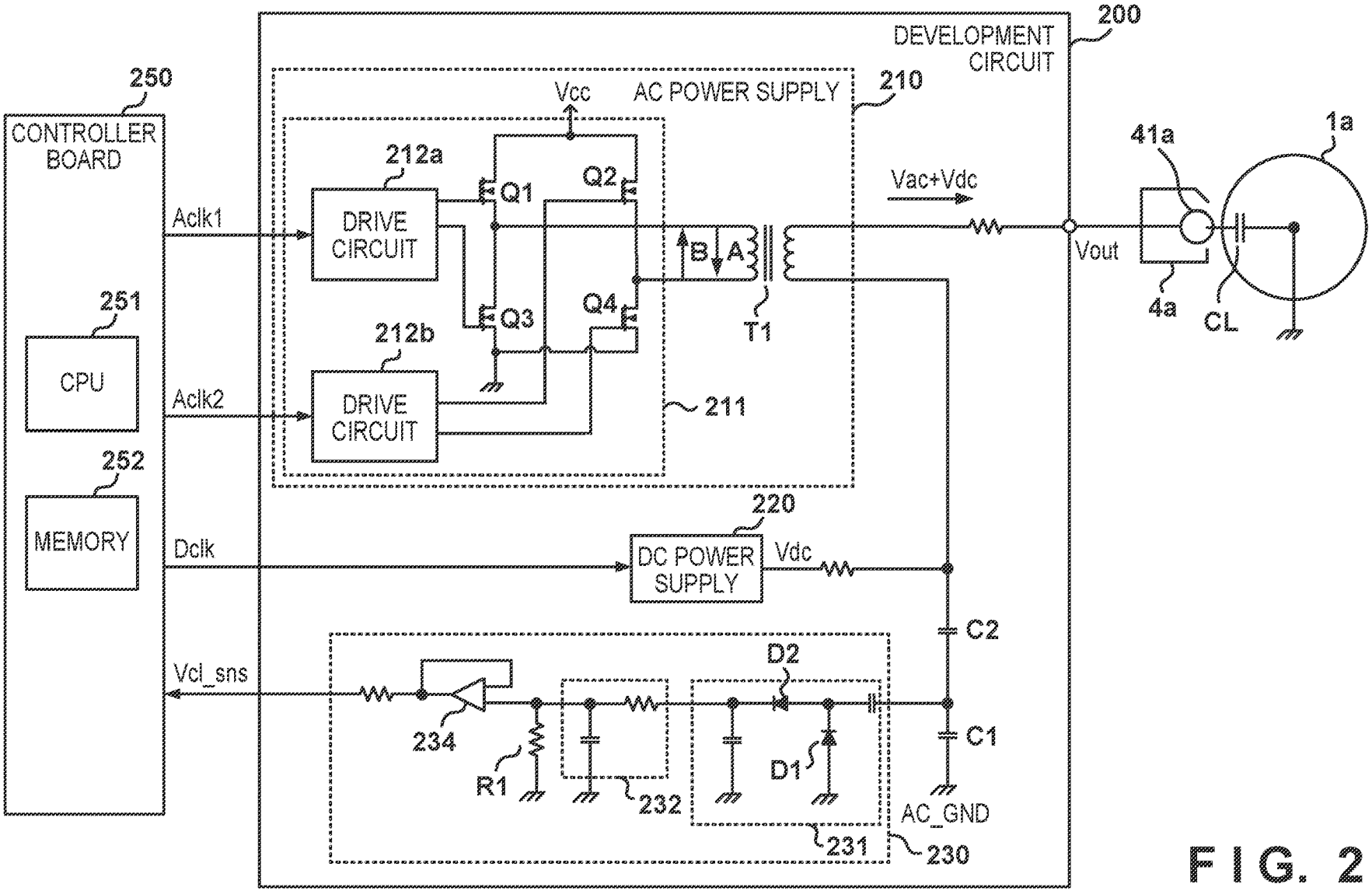
FIG. 2 is a diagram for describing a controller and a power supply circuit.

As illustrated in FIG. 2, a development circuit 200 is a power supply circuit that supplies a development voltage Vout to the developing device 4*a*. One development circuit 200 is provided on each of the developing devices 4*a* to 4*d*. As the four development circuits 200 share a common configuration and operation, herein, only the development circuit 200 for the developing device 4*a* will be described.

A controller board 250 includes a CPU 251 and memory 252 and controls the development circuit 200. The CPU 251 controls the development circuit 200 by executing a control program stored in a ROM area of the memory 252. For example, the CPU 251 generates clock signals Aclk1, Aclk2, Dclk, and the like and outputs these to the development circuit 200. Also, the CPU 251 determines a waveform form of the clock signals Aclk1, Aclk2 on the basis of a detection voltage Vcl_sns indicating a detection result of a load capacitance (electrostatic capacitance CL) between the developing sleeve 41*a* and the photosensitive drum 1*a*. A waveform pattern is a pattern of change in the waveform of the clock signals Aclk1, Aclk2 over time. A waveform pattern may be referred to as a change pattern or a driving pattern. In this manner, in the present embodiment, the adjustment time for the development voltage Vout is reduced because the waveform pattern can be immediately determined on the basis of a measurement result of the electrical characteristic between the developing sleeve 41*a* and the photosensitive drum 1*a*.

The development circuit 200 includes an AC power supply 210, a DC power supply 220, and a detection circuit 230. The DC power supply 220 generates a DC voltage Vdc, which is a voltage value according to the clock signal Dclk, and supplies this to the AC power supply 210. The AC power supply 210 generates an AC voltage Vac, which is a voltage value according to the clock signals Aclk1, Aclk2. The generated AC voltage Vac is superimposed with the DC voltage Vdc, and the superimposed voltage is applied to the developing sleeve 41*a* as the development voltage Vout. The detection circuit 230 detects an electrostatic capacitance CL on the basis of the development voltage Vout and outputs the detection voltage Vcl_sns indicating the electrostatic capacitance CL to the CPU 251.

A distance d between the developing sleeve 41*a* and the photosensitive drum 1*a* is a few hundred μms, for example. Herein, μm represents micrometers. Considering that this is an electrical equivalent circuit, there is a correlation between the distance d and the electrostatic capacitance CL.

$$CL = e \times \frac{S}{d} \tag{1}$$

Herein, e represents a dielectric constant. S represents the opposing surface area of the photosensitive drum 1*a* in relation to the developing sleeve 41*a* involved in development. As can be seen from Formula (1), a change in the distance d corresponds to a change in the electrostatic capacitance CL. Thus, the distance d affects the waveform of the AC voltage Vac. The variation in the electrostatic capacitance CL caused by a change in the distance d can range from 150 pF to 220 pF, for example.

The AC power supply 210 includes a transformer T1 and a primary side circuit 211. When the primary side circuit 211 drives the transformer T1, the AC voltage Vac with a rectangular wave is generated.

The primary side circuit 211 includes a full bridge circuit and drive circuits 212*a*, 212*b*. The full bridge circuit in constituted by switching elements Q1 to Q4, which are NMOS transistors, for example. The output side of the full bridge circuit is connected to a primary winding wire of the transformer T1. The input side of the full bridge circuit is connected to the drive circuits 212*a*, 212*b*. The drive circuit 212*a* generates two drive signals according to the clock signal Aclk1 and turns the switching elements Q1, Q3 on and off. The drive circuit 212*b* generates two drive signals according to the clock signal Aclk2 and turns the switching elements Q2, Q4 on and off. A reference voltage Vcc is applied to the full bridge circuit.

In a case where the clock signal Aclk1 is a high state, the drive circuit 212*a* turns on the switching element Q1 and turns off the switching element Q3. In a case where the clock signal Aclk1 is a low state, the drive circuit 212*a* turns off the switching element Q1 and turns on the switching element Q3. In a case where the clock signal Aclk2 is a high state, the drive circuit 212*b* turns on the switching element Q2 and turns off the switching element Q4. In a case where the clock signal Aclk2 is a low state, the drive circuit 212*b* turns off the switching element Q2 and turns on the switching element Q4.

To make the transformer T1 output a positive voltage, the clock signal Aclk1 is set to the high state and the clock signal Aclk2 is set to the low state. Accordingly, the switching elements Q1, Q4 are turned on, and the switching elements Q2, Q3 are turned off. As a result, a voltage in the direction of arrow A flows through the primary winding wire of the transformer T1.

Conversely, to make the transformer T1 output a negative voltage, the clock signal Aclk1 is set to the low state and the clock signal Aclk2 is set to the high state. Accordingly, the switching elements Q1, Q4 are turned off, and the switching elements Q2, Q3 are turned on. As a result, a voltage in the direction of arrow B flows through the primary winding wire of the transformer T1.

A first end of a secondary winding wire of the transformer T1 is connected to the developing sleeve 41*a*. A second end of the secondary winding wire of the transformer T1 is connected to a series circuit of capacitors C1, C2. The impedance of each of the capacitors C1, C2 is set sufficiently low enough to allow an operation current of the transformer T1 to be obtained. A second end of the series circuit of the capacitors C1, C2 is connected to a ground potential AC_GND.

The capacitor C1 forms a capacitive voltage divider circuit together with the electrostatic capacitance CL and the capacitor C2 for detecting the electrostatic capacitance CL. In the present example, the capacitor C1 is 0.068 uF, for example. The capacitor C2 is 4700 pF, for example. The values relating to electrical characteristics indicated in the present example are merely examples.

The detection circuit 230 includes a peak hold circuit 231, a low-pass filter 232, and a voltage follower circuit 234. The peak hold circuit 231 includes diodes D1, D2, a capacitor for holding, and the like. The peak hold circuit 231 holds a peak-to-peak voltage (Vpp) of the AC voltage generated at both ends of the capacitor C1. The Vpp voltage generated at both ends of the capacitor C1 is represented by the following formula.

$$Vpp = 1000[V] \times \frac{Cs}{C1} \quad (2)$$

Herein, Cs represents the combined capacitance of the capacitors C1, C2, CL connected in series. The combined capacitance Cs is represented by the following formula. 1000 V is the peak-to-peak value of the development voltage Vout.

$$\frac{1}{Cs} = \frac{1}{C1} + \frac{1}{C2} + \frac{1}{CL} \quad (3)$$

For example, in a case where the electrostatic capacitance CL is 200 pF, the combined capacitance Cs is calculated as approximately 191 pF using Formula (3). Also, the Vpp voltage is calculated using Formula (2) as 1000 V×191 pF/0.68 uF=2.81 V. The Vpp voltage is input to the peak hold circuit 231. The peak hold circuit 231 includes a diode D1 for raising the input voltage (Vpp voltage) to the GND reference and a diode D2 for holding the peak of the input voltage. The input voltage is output to the low-pass filter 232 after only the forward voltage VF of the two diodes D1, D2 is lowered. In a case where the forward voltage VF is 0.6 V, for example, the voltage output from the peak hold circuit 231 is 2.81 V−0.6 V×2=1.61 V.

The voltage output from the peak hold circuit 231 is input to the low-pass filter 232. In a case where an overshoot is generated in the AC voltage Vac, the overshoot affects the detection signal Vcl_sns. Thus, the low-pass filter 232 removes a high frequency component caused by an overshoot from the input voltage. The low-pass filter 232 may be constituted by an LC circuit including a resistance and a capacitor, for example.

The voltage follower circuit 234 is provided for converting impedance. Accordingly, even in a case where the input voltage is a weak voltage, a more precise detection signal Vcl_sns can be obtained. The voltage follower circuit 234 may be constituted by an operational amplifier, for example. A resistance R1 is a pull-down resistor for discharging a charge accumulated in the capacitors included in the peak hold circuit 231 and the low-pass filter 232.

Development Voltage and Clock Signal

Figure 3:
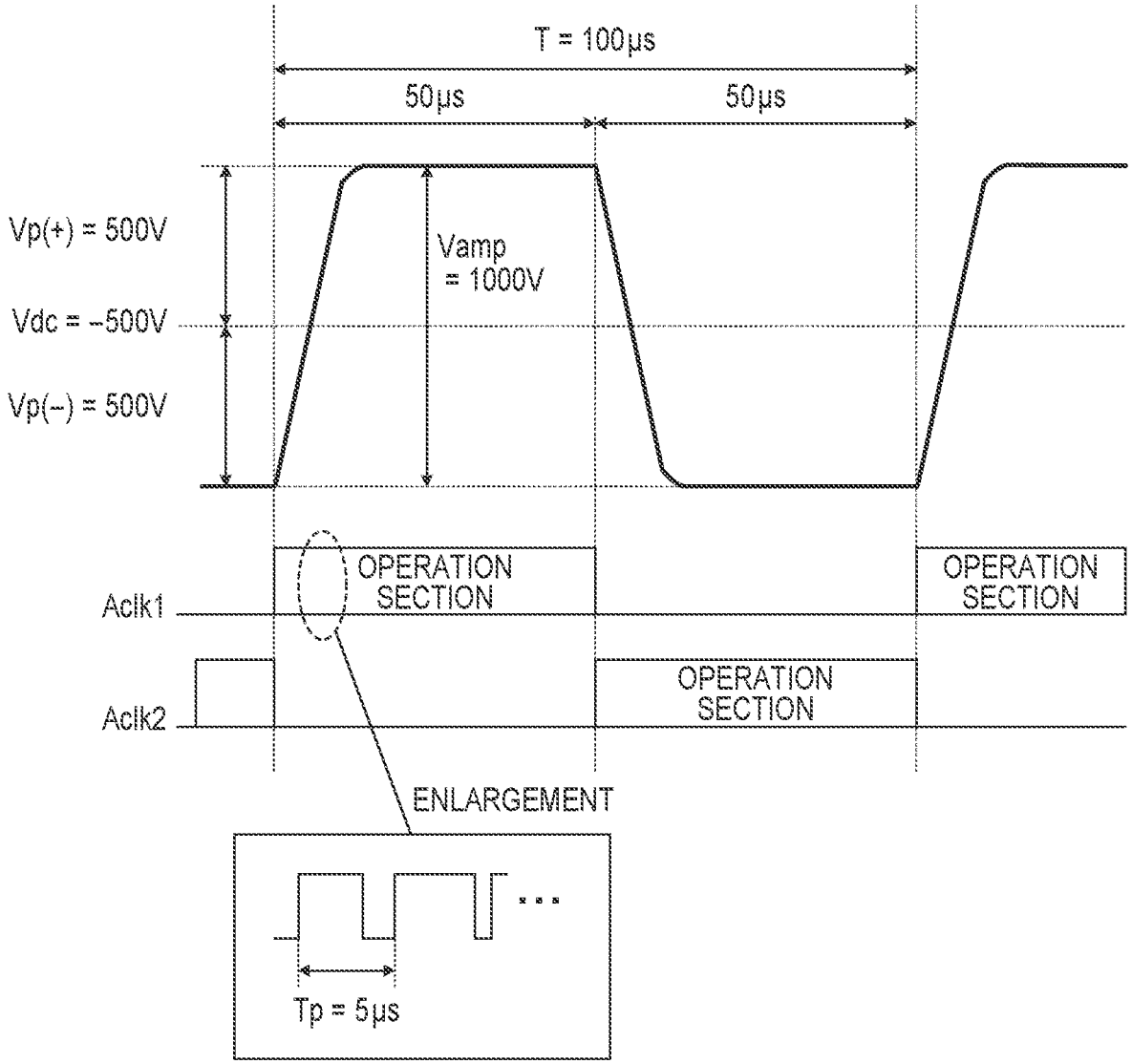
FIG. 3 is a diagram for describing the relationship between a control signal and an AC voltage.

FIG. 3 illustrates the relationship between the development voltage Vout and the clock signals Aclk1, Aclk2. In this example, the DC voltage Vdc is −500 V. Accordingly, the development voltage Vout corresponds to a voltage equaling the AC voltage Vac offset by −500 V. As illustrated in FIG. 3, in this example, the positive amplitude Vp(+) of the AC voltage Vac is 500 V. Also, in this example, the negative amplitude Vp(−) is 500 V. Thus, in this example, the amplitude Vamp of the AC voltage Vac is 1000 V.

In this example, the duty ratio on the positive side of the AC voltage Vac and the duty ratio on the negative side are both 50%. In this example, a period T of the AC voltage Vac is 100 μs (i.e., frequency f=10 kHz).

As illustrated in FIG. 3, when the polarity of the AC voltage Vac is positive, the clock signal Aclk1 is in the operation section. Also, it can be seen that the clock signal Aclk2 is fixed in the off state (low state). Alternatively, when the polarity of the AC voltage Vac is negative, the clock signal Aclk1 is fixed in the off state (low state). Also, the clock signal Aclk2 is in the operation section.

The clock signals Aclk1, Aclk2 are not always maintained in the on state (high state) in the operation section. As illustrated in FIG. 3, the clock signals Aclk1, Aclk2 correspond to a pulse signal in which the clock signals Aclk1, Aclk2 repeatedly alternate between the on and off state. Accordingly, the clock signals Aclk1, Aclk2 may be subject to pulse width modulation (PWM). For example, the pulse width modulated period T may be 5 μs.

Figure 4A:
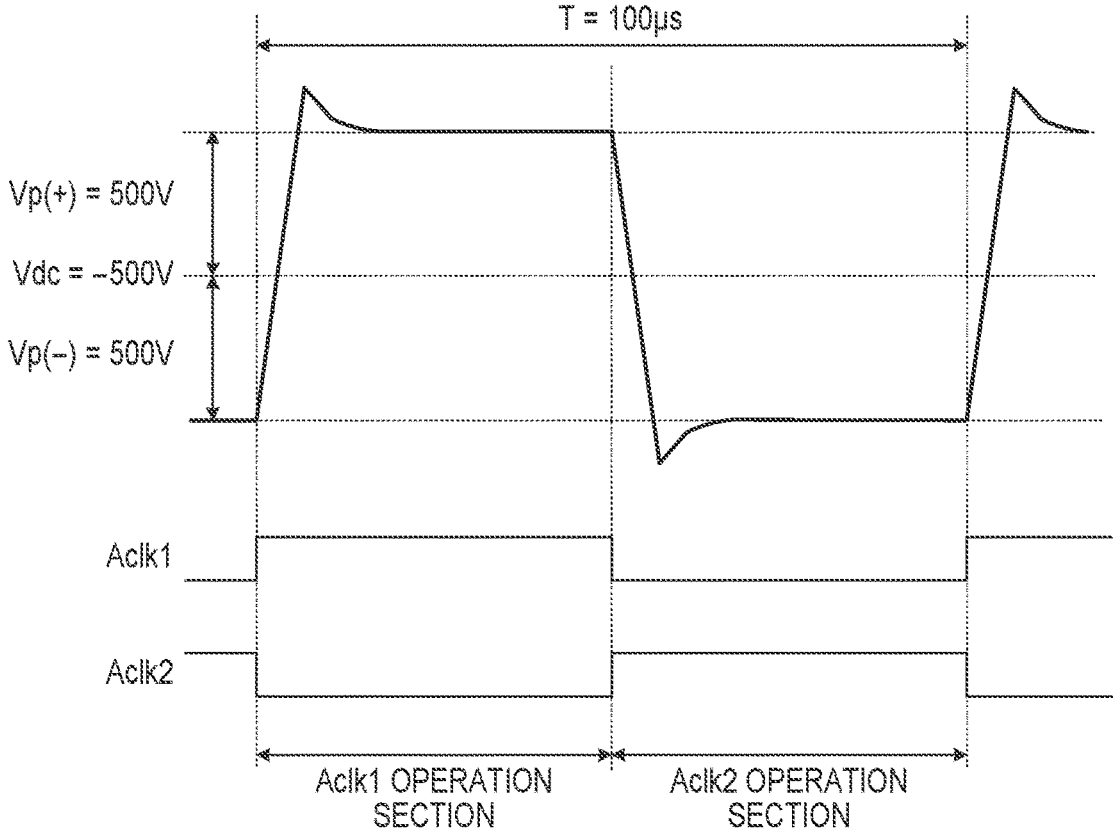
FIGS. 4A and 4B are diagrams for describing a method of reducing overshoot.
Figure 4B:
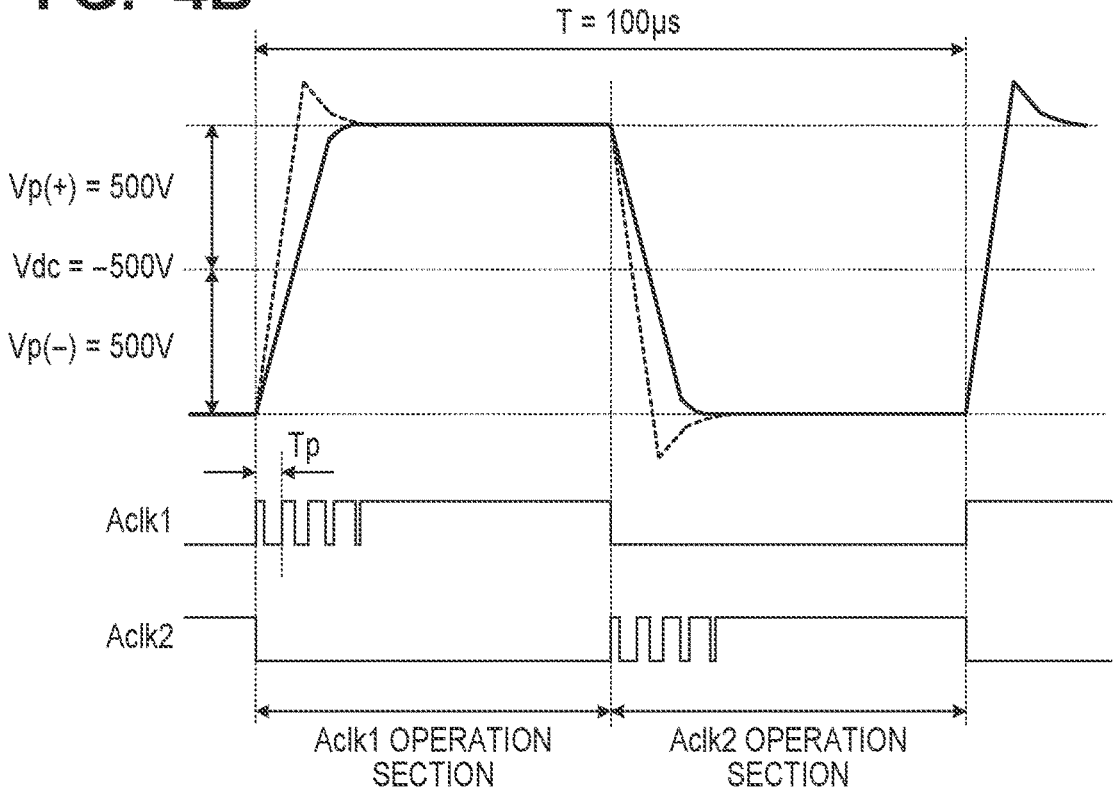

FIG. 4A illustrates the development voltage Vout in a case where the clock signals Aclk1, Aclk2 are not subject to PWM. FIG. 4B illustrates the development voltage Vout in a case where the clock signals Aclk1, Aclk2 are subject to PWM.

As illustrated in FIG. 4A, in a case where the clock signal Aclk1 or the clock signal Aclk2 is always maintained in the on state, the inductance component of the transformer T1, the capacitance between the winding wire, and the electrostatic capacitance CL may cause resonance. This generates an overshoot in the AC voltage Vac. An overshoot causes an unintended leak current and an accompanying disruption in the electrostatic latent image. Thus, overshooting needs to be reduced.

As illustrated in FIG. 4B, the pulse width is modulated in the operation section of the clock signal Aclk1 and/or the clock signal Aclk2. This allows a discretionary average voltage to be obtained in the pulse section of a period Tp. By making the on period shorter and the off period longer at the time when overshooting occurs, the average voltage in the period Tp is reduced. This suppresses overshooting in the AC voltage Vac.

There is also a phenomenon that is the opposite of overshoot in which the rising waveform of the AC voltage Vac is made a gentle rise. In this case, the on period is made longer and the off period is made shorter to increase the average voltage in the period Tp. This gives the waveform a steep rise.

In this manner, by adjusting (PWM) the on period (duty) in the period Tp, the inclination of the rise of the AC voltage Vac and the inclination of the fall can be controlled. Specifically, as illustrated in FIG. 4B, the on period in the pulse section of the period Tp gradually increases from the start of each operation section of the clock signal. Also, in the second half of each operation section, the off period is zero. As a result, the development voltage Vout with a reduced overshoot is obtained.

The shorter the period Tp of the pulse, the more finely the waveform of the AC voltage Vac can be adjusted. A frequency fp of the pulse is set sufficiently higher than the frequency f of the AC voltage Vac. In the present example, for example, the period Tp of the pulse is 5 μs (frequency fp=200 kHz). In this example, the period T of the AC voltage Vac is 100 μs. In this case, 20 pulse sections fit in one period T of the AC voltage Vac.

Electrostatic Capacitance CL and Detection Signal Vcl_sns

Figure 5:
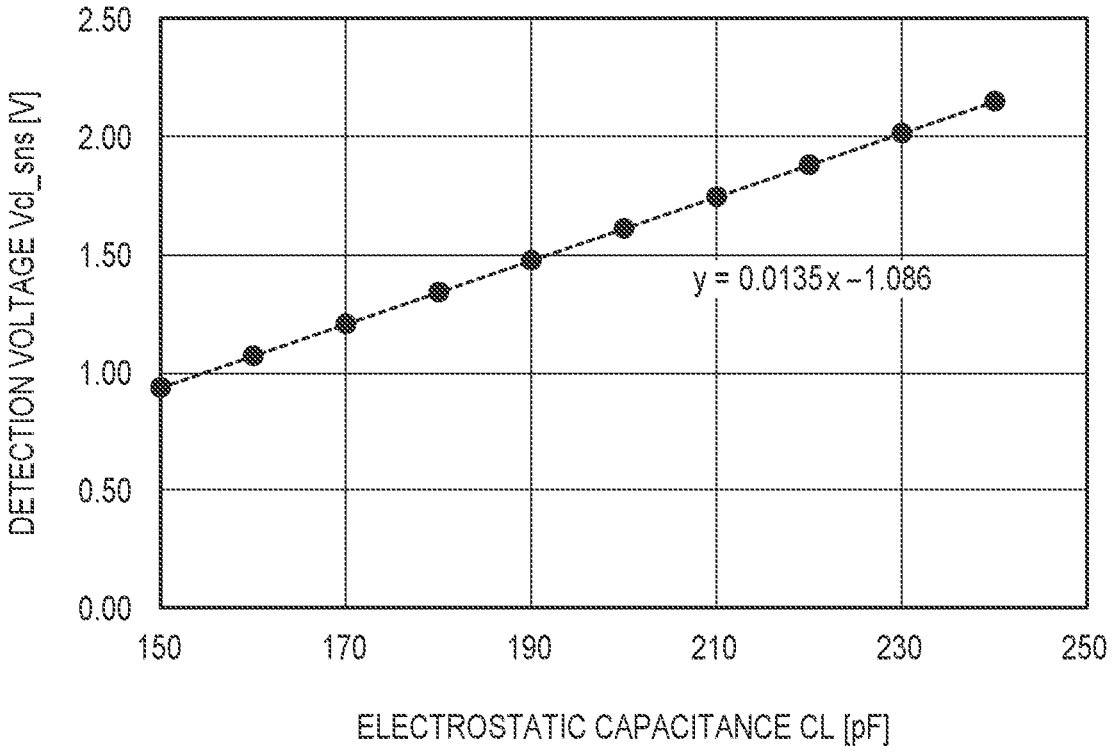
FIG. 5 is a diagram for describing the relationship between an electrostatic capacitance and a detection voltage.

FIG. 5 illustrates the relationship between the electrostatic capacitance CL and the detection signal Vcl_sns. The electrostatic capacitance CL and the detection signal Vcl_sns have a proportional relationship, via Formula (2) and Formula (3). Thus, the CPU 251 is capable of obtaining the electrostatic capacitance CL using the detection signal Vcl_sns. The mathematical formula indicating the proportional relationship may be stored in advance in the memory 252 and used by the CPU 251. In other words, the CPU 251 is capable of estimating the electrostatic capacitance CL using the detection signal Vcl_sns.

The memory 252 stores in advance a control table (conversion table) holding the electrostatic capacitance CL and setting values of the clock signals Aclk1, Aclk2 associated together. The setting values correspond to the change patterns of the clock signals Aclk1, Aclk2.

FIG. 6 illustrates an example of the control table held in the memory 252. In this example, the electrostatic capacitance CL is divided into three capacitance ranges. Each capacitance range is associated with change patterns of the clock signals Aclk1, Aclk2. The change patterns indicate the duty ratios of the clock signals Aclk1, Aclk2 in a single period (T=100 μs) of the AC voltage Vac. In this example, one period of the AC voltage Vac is divided into 20 sections. Thus, 20 setting values for each of the clock signals Aclk1, Aclk2 are stored in the control table. Accordingly, the change patterns of each clock signal include 20 setting values.

In a case where the fluctuation amount of the electrostatic capacitance CL is approximately 30 pF, the quality of the toner image is maintained at the design-intended quality. Thus, the width of the range of the electrostatic capacitance is set to 30 pF.

The CPU 251 selects one change pattern from three change patterns on the basis of the detection signal Vcl_sns. The CPU 251, from the first section to the twentieth section, generates and outputs the clock signals Aclk1, Aclk2 according to the selected change pattern. In the present example, the first section to the tenth section are sections where the positive AC voltage Vac is output. The eleventh section to the twentieth section are sections where the negative AC voltage Vac is output.

CPU Functions

Figure 7:
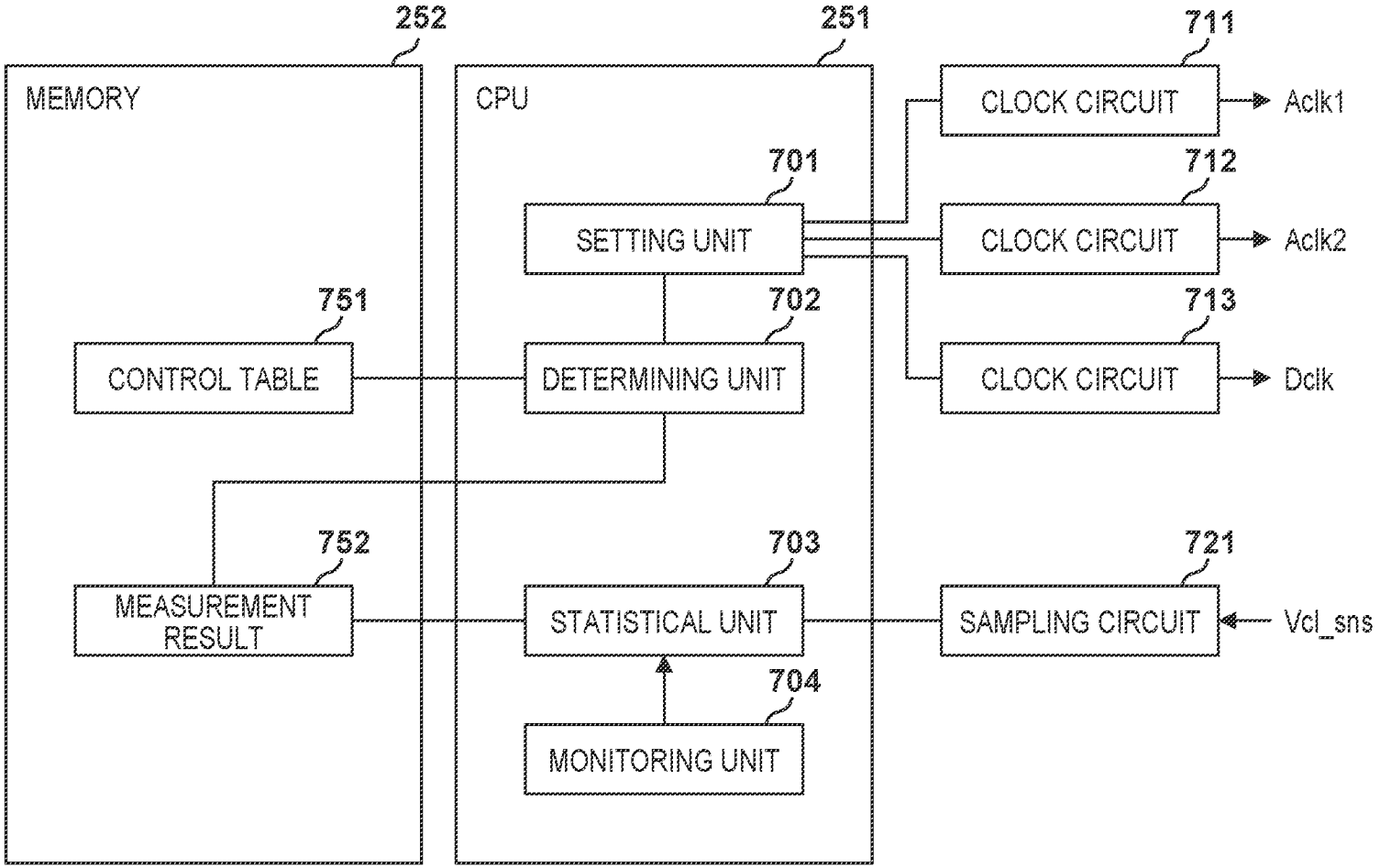
FIG. 7 is a diagram for describing functions of a CPU.

FIG. 7 illustrates the functions implemented by the CPU 251 executing a control program. At least one of or a plurality of the functions may be realized by a hardware circuit, such as an ASIC, an FPGA, or the like. ASIC stands for an application-specific integrated circuit. FPGA stands for a field-programmable gate array.

A setting unit 701 sets the duty ratio (on period) for clock circuits 711, 712 according to a change pattern output from or designated by a determining unit 702. The clock circuit 711 generates the clock signal Aclk1. The clock circuit 712 generates the clock signal Aclk2. A clock circuit 713 generates the clock signal Dclk. A RAM area of the memory 252 holds a measurement result 752 of the detection signal Vcl_sns. The determining unit 702 references a control table 751 and determines the change pattern on the basis of the measurement result 752 read out from the memory 252. For example, the determining unit 702 may obtain, from the control table 751, a conversion pattern corresponding to the electrostatic capacitance CL obtained from the detection signal Vcl_sns. In this manner, the determining unit 702 may function as a conversion unit that converts the measurement result 752 to a change pattern.

A sampling circuit 721 is a circuit (analog digital conversion circuit) that samples the voltage of the detection signal Vcl_sns. The sampling circuit 721 may be an AD conversion port provided in the CPU 251. A statistical unit 703 obtains the measurement result 752 via statistical processing of the sampled value output from the sampling circuit 721 and writes this to the memory 252. Note that a monitoring unit 704 may issue an instruction to update the measurement result 752. The monitoring unit 704 monitors for events that may significantly change the electrostatic capacitance. In a case where the monitoring unit 704 detects such an event, the monitoring unit 704 instructs the statistical unit 703 to update the measurement result 752. Examples of such events include power being supplied from a commercial power supply and activating the image forming apparatus 100, the number of sheets printed reaching a predetermined number, the developing device 4 being replaced, and the like. Each time a print job is input, the measurement result 752 may be updated. However, updating the measurement result 752 when a predetermined event occurs may result in further reducing the user waiting time. "Event" may be referred to as an update condition for updating the measurement result 752 or a reselection condition for reselecting the change pattern.

Flowchart

Figure 8:
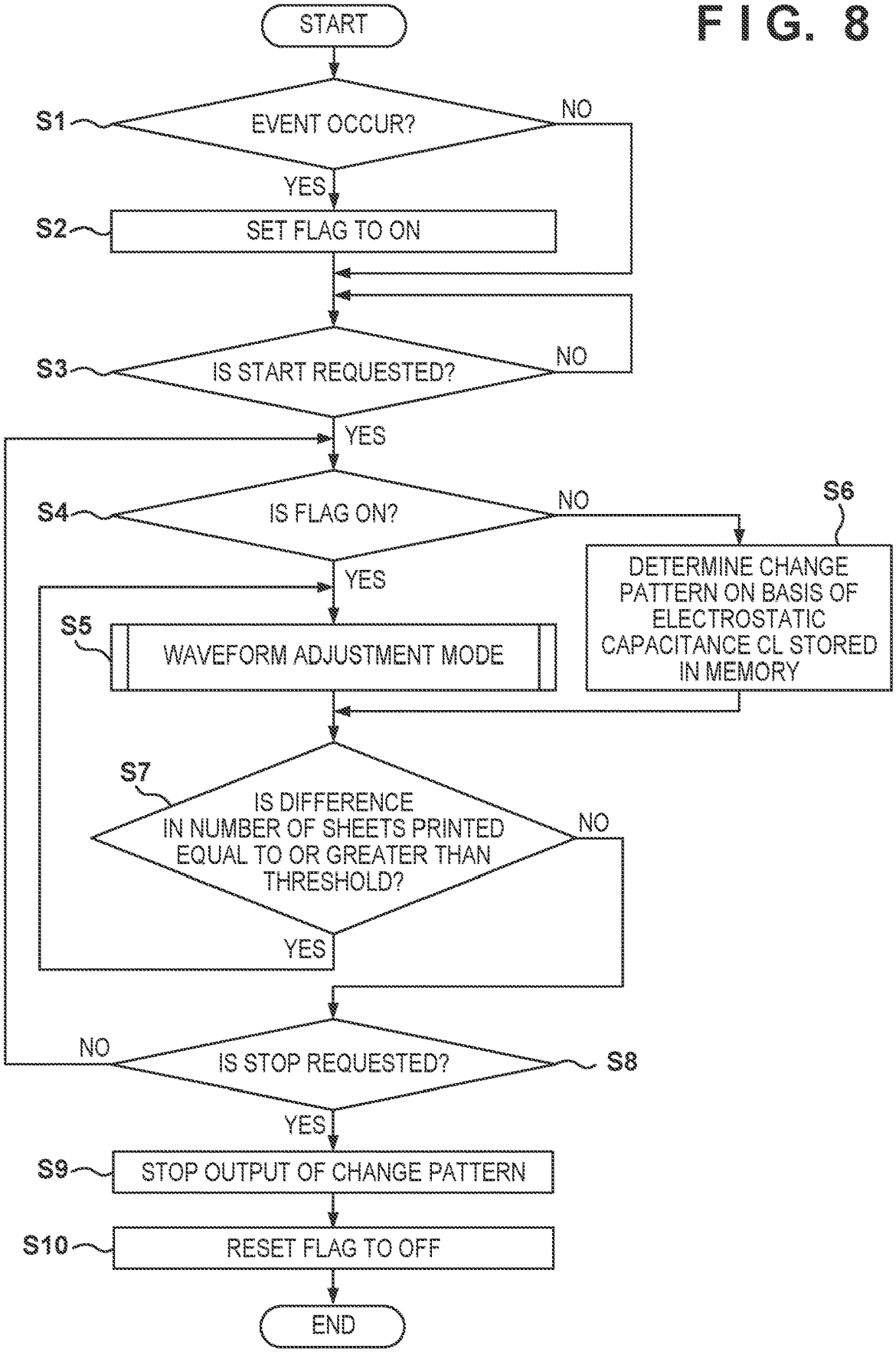
FIG. 8 is a flowchart illustrating a control method.

FIG. 8 is a flowchart illustrating the waveform control of the AC voltage Vac executed by the CPU 251. When the CPU 251 receives a print request, the CPU 251 starts waveform control.

In step S1, the CPU 251 (the monitoring unit 704) determines whether or not a predetermined event has occurred. As described above, the predetermined event is an event by which the current measured electrostatic capacitance CL is likely to be significantly changed relative to the previously measured electrostatic capacitance CL. In a case where the predetermined event has occurred, the CPU 251 proceeds the processing to step S2. In a case where the predetermined event has not occurred, the CPU 251 proceeds the processing to step S3.

In step S2, the CPU 251 (the monitoring unit 704) set a flag to on to allow a waveform adjustment mode to be executed. In step S3, the CPU 251 (the monitoring unit 704) determines whether or not the start of output of the development voltage Vout has been requested. In a case where the start of output of the development voltage Vout has been requested, the CPU 251 proceeds the processing to step S4.

In step S4, the CPU 251 (the monitoring unit 704) determines whether or not the flag is on. In a case where the flag is on, the CPU 251 proceeds the processing to step S5. In a case where the flag is off, the CPU 251 proceeds the processing to step S6.

In step S5, the CPU 251 executes the waveform adjustment mode. The waveform adjustment mode is processing including measuring the electrostatic capacitance CL and updating the measurement result 752 and the change pattern. Next, the CPU 251 proceeds the processing to step S7.

In step S6, the CPU 251 (the determining unit 702) determines the change pattern on the basis of the measurement result 752 held by the memory 252. The determining unit 702 references the control table 751 and selects a change pattern corresponding to the measurement result 752. The determining unit 702 may use a mathematical formula or the like to calculate the change pattern from the measurement result 752. The setting unit 701 controls the clock circuits 711, 712 according to the selected change pattern and makes the clock signals Aclk1, Aclk2 be outputted. The CPU 251 controls the clock circuit 713 and outputs the predetermined clock signal Dclk. The development circuit 200 outputs the development voltage Vout according to the clock signals Aclk1, Aclk2, Dclk.

In step S7, the CPU 251 determines whether or not a difference in the number of sheets printed, which is the difference between the number of sheets printed during a previously executed waveform adjustment mode and the current number of sheets printed, is equal to or greater than a threshold. The CPU 251 counts the number of sheets printed (number of images formed) and holds this in the memory 252. In a case where the difference in the number of sheets printed is equal to or greater than the threshold, the CPU 251 proceeds the processing to step S5 and the waveform adjustment mode is executed again. By executing the waveform adjustment mode again, the difference in the number of sheets printed is re-calculated. In a case where the difference in the number of sheets printed is not equal to or greater than the threshold, the CPU 251 proceeds the processing to step S8. The threshold is determined by experiment or simulation and is 1000 sheets, for example.

In step S8, the CPU 251 (the monitoring unit 704) determines whether or not a stop of the development voltage Vout has been requested. For example, in cases where the number of images designated by a print job have all been formed or where an instruction is received to stop a print job, a stop of the development voltage Vout is requested. In a case where a stop of the development voltage Vout has not been requested, the CPU 251 proceeds the processing to step S4. In a case where a stop of the development voltage Vout has been requested, the CPU 251 proceeds the processing to step S9.

In step S9, the CPU 251 (the setting unit 701) instructs the clock circuits 711, 712, 713 to stop the clock signals Aclk1, Aclk2, Dclk. In a case where the output of the clock signals Aclk1, Aclk2, Dclk is stopped, the development circuit 200 stops the output of the development voltage Vout. In step S10, the CPU 251 (the monitoring unit 704) resets the flag to zero.

Figure 9:
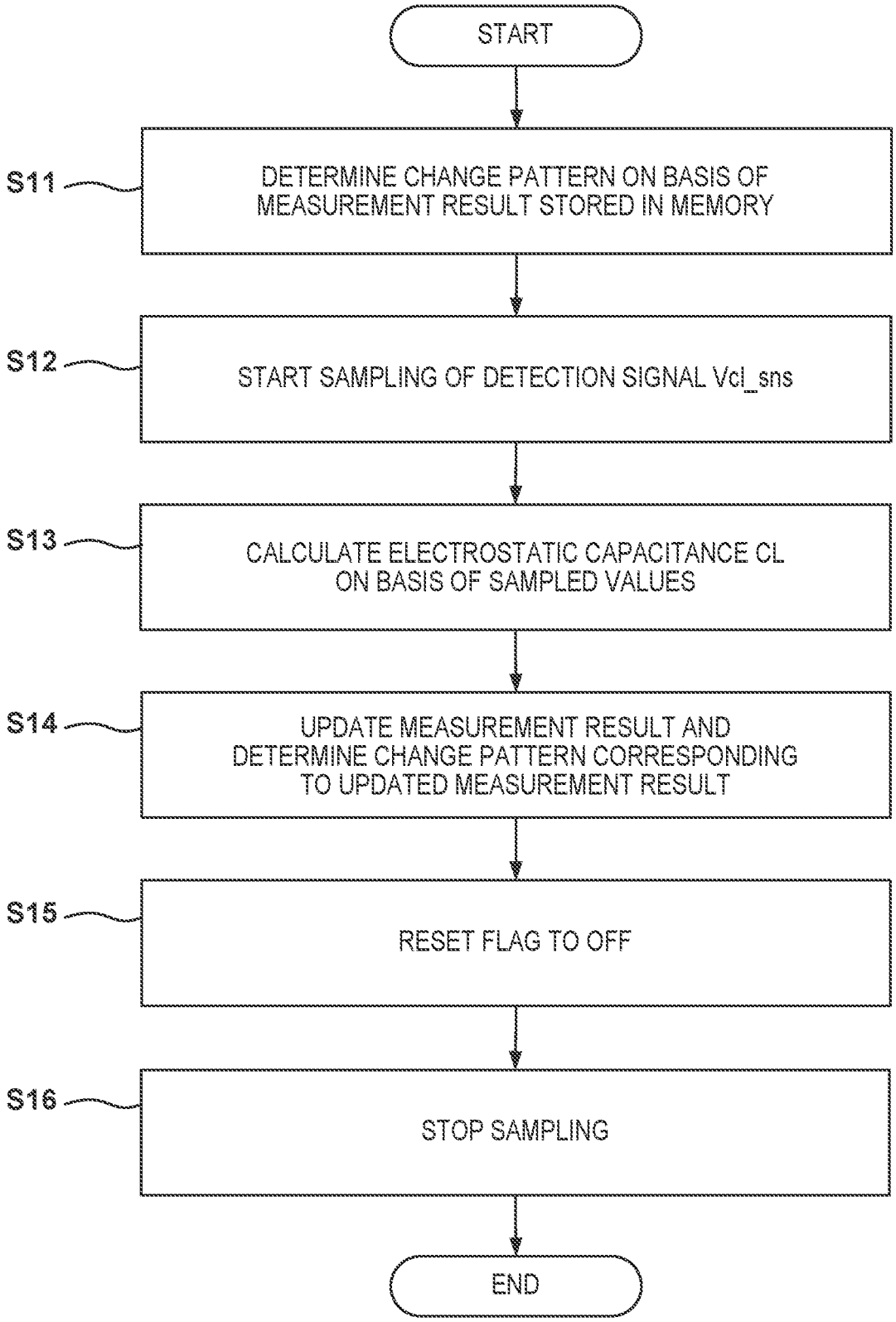
FIG. 9 is a flowchart illustrating a waveform adjustment mode.

FIG. 9 illustrates step S5 described above in detail. In step S11, the CPU 251 (the determining unit 702) determines the change pattern on the basis of the measurement result 752 of the electrostatic capacitance CL stored in the memory 252. The setting unit 701 controls the clock circuits 711, 712 on the basis of the change pattern determined by the determining unit 702. In this manner, the AC power supply 210 generates the AC voltage Vac. In parallel, the clock circuit 711 also supplies the clock signal Dclk to the DC power supply 220. In this manner, the DC power supply 220 outputs the predetermined DC voltage Vdc.

In step S12, the CPU 251 (the statistical unit 703) controls the sampling circuit 721 to start sampling of the detection voltage Vcl_sns. Note that sampling is started at a time when the development voltage Vout is stable. For example, the CPU 251 determines whether or not a certain amount of time (for example, 100 ms) has elapsed since output of the AC voltage Vac started. In a case where a certain amount of time (for example, 100 ms) has elapsed since output of the AC voltage Vac started, the amplitude Vamp of the AC voltage Vac is considered to be stable at a target voltage (for example, 1000 V). The sampling circuit 721 obtains N number of sampled values according to a predetermined sampling period (for example, 20 μs) set by the CPU 251. N may be 5, for example. N is obtained by dividing the period T of the AC voltage Vac by the sampling period.

In step S13, the CPU 251 (the statistical unit 703) calculates the electrostatic capacitance CL on basis of the sampled values of the detection signal Vcl_sns. For example, a statistical value (for example, an average value) of the N number of sampled values of the statistical unit 703 may be calculated. The statistical value corresponds to a new measurement result 752 of the electrostatic capacitance CL.

In step S14, the CPU 251 (the statistical unit 703) updates the measurement result 752 by overwriting the old measurement result 752 with a new measurement result 752 of the electrostatic capacitance CL. Also, the CPU 251 (the determining unit 702) determines the change pattern corresponding to the updated measurement result 752. The determining unit 702 sets the newly determined change pattern in the setting unit 701. The setting unit 701 controls the clock circuits 711, 712 according to the new change pattern. In this manner, the waveform of the AC voltage Vac included in the development voltage Vout is adjusted.

In step S15, the CPU 251 resets the flag to off. In step S16, the CPU 251 stops the sampling of the detection signal Vcl_sns and ends the waveform adjustment mode.

Figure 10:
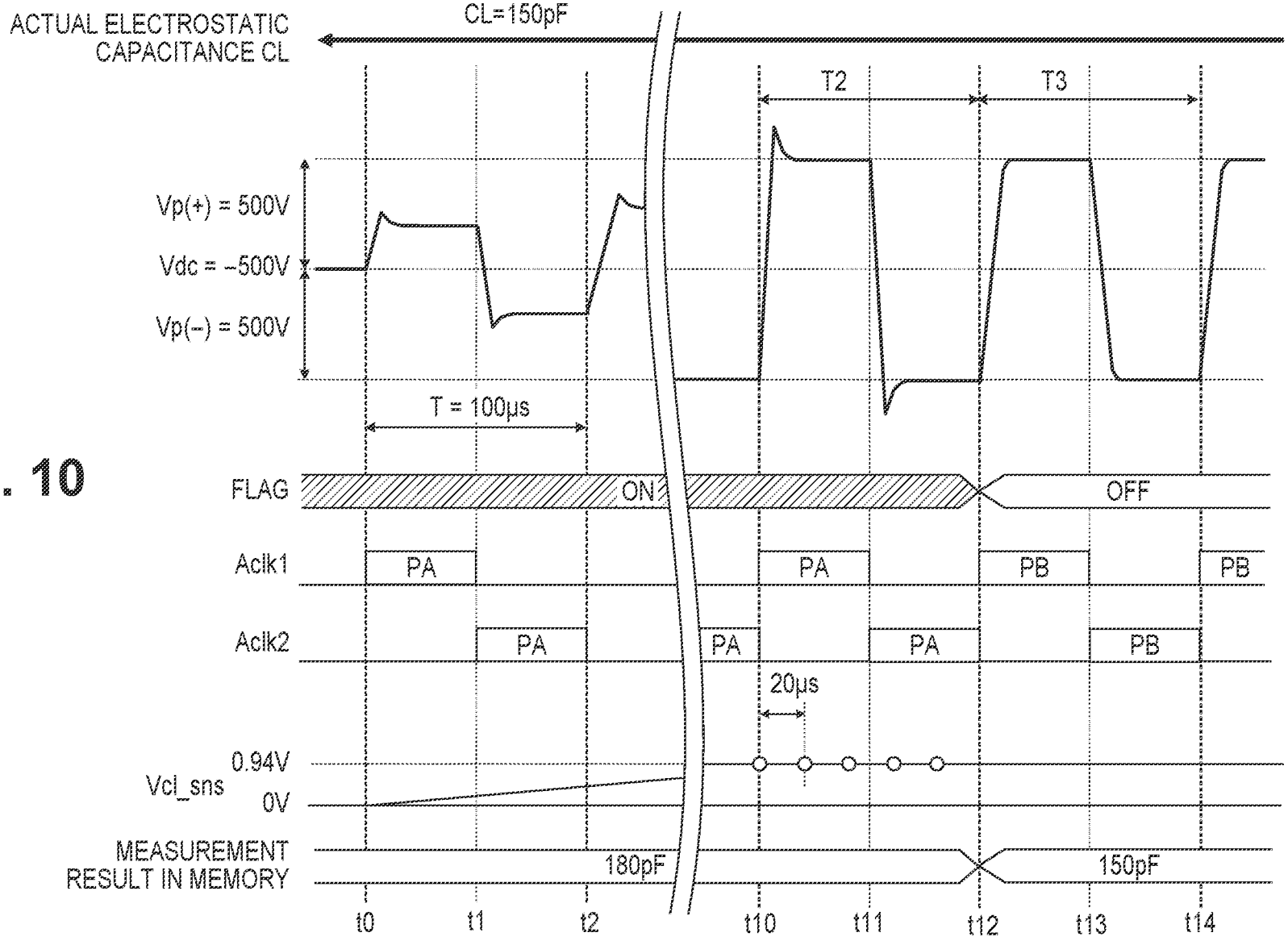
FIG. 10 is a diagram for describing waveform adjustment.

FIG. 10 illustrates a case of the electrostatic capacitance CL fluctuating due to the replacement of the developing device 4*a*. In this example, the electrostatic capacitance CL changes from 180 pF (pre-replacement) to 150 pF (post-replacement).

Output of the AC voltage Vac starts at a time t0. Prior to time t0, the developing device 4*a* has been replaced and the flag has already been set to on. Thus, execution of the waveform adjustment mode is started at time t0. The measurement result 752 of the electrostatic capacitance CL held in the memory 252 is unchanged at 180 pF. When the start of output of the AC voltage Vac is requested, the CPU 251 selects a change pattern PA suitable to 180 pF and starts output of the clock signals Aclk1, Aclk2. In parallel, the DC voltage Vdc is also output.

When output of the AC voltage Vac is started, the voltage of the detection signal Vcl_sns starts to rise. That is, as time progresses from time t0 through t1 and t2, the voltage rises.

Time t10 is the point in time when a certain amount of time has elapsed since the start of outputting the AC voltage Vac. In a section T2 from the time t10 to a time t12, the AC voltage Vac is stable. At this time, the amplitude Vamp for the AC voltage Vac stays at 1000 V. The detection signal Vcl_sns is also stable. The voltage of the detection signal Vcl_sns is stable at 0.94 V. In a case where 0.94 V is converted to the electrostatic capacitance CL, it corresponds to 150 pF.

In the section T2, overshooting in the waveform of the AC voltage Vac can be observed. This is due to the replacement of the developing device 4*a*. In other words, the actual electrostatic capacitance CL is 150 pF. However, this is because the change pattern of the clock signals Aclk1, Aclk2 has been selected on the basis of the previous measurement result (180 pF).

The CPU 251 starts sampling of the detection signal Vcl_sns at the time t10. The CPU 251 obtains five sampled values with a sampling period of 20 μs. The CPU 251 obtains the average value of the five sampled values. The average value is 150 pF. The CPU 251 updates the measurement result 752 from 180 pF to 150 pF. As a result, the CPU 251 selects a change pattern PB as a new change pattern. At time t12, the change pattern is updated from PA to PB. After the time t12, the CPU 251 outputs the clock signals Aclk1, Aclk2 according to the change pattern PB to the AC power supply 210. In a section T3, the overshoot included in the AC voltage Vac is reduced to less than that in the section T2.

In this manner, according to the present example, an appropriate waveform pattern is quickly determined on the basis of the electrostatic capacitance CL of the developing device 4*a*. This allows the waiting time for waveform adjustment to be reduced.

In this example, a capacitive voltage divider circuit includes capacitors CL, C1, C2 is used divide the development voltage Vout. However, this is merely an example. In other examples, the capacitor C1 may be substituted with a current detecting resistance that detects a development current correlating to the development voltage Vout. In this case, the detection signal Vcl_sns indicates the voltage generated at the current detecting resistance. Note that the development current also correlates to the electrostatic capacitance CL.

Also, as the AC power supply 210, a full bridge circuit that drives the transformer T1 is used. However, a half bridge circuit or a push-pull circuit with an equivalent function may be used.

In the example described above, the positive amplitude and the negative amplitude of the AC voltage Vac is in a state of equilibrium. The duty ratio in the time period a positive amplitude is output and the duty ratio in the time period a negative amplitude is output is in a state of equilibrium. However, this is merely an example, and a state of non-equilibrium may be used. For example, the positive amplitude may be 40%, and the negative amplitude may be 60%. In this case, the duty ratio relating to the positive amplitude may be 60%, and the duty ratio relating to the negative amplitude may be 40%.

Figure 11:
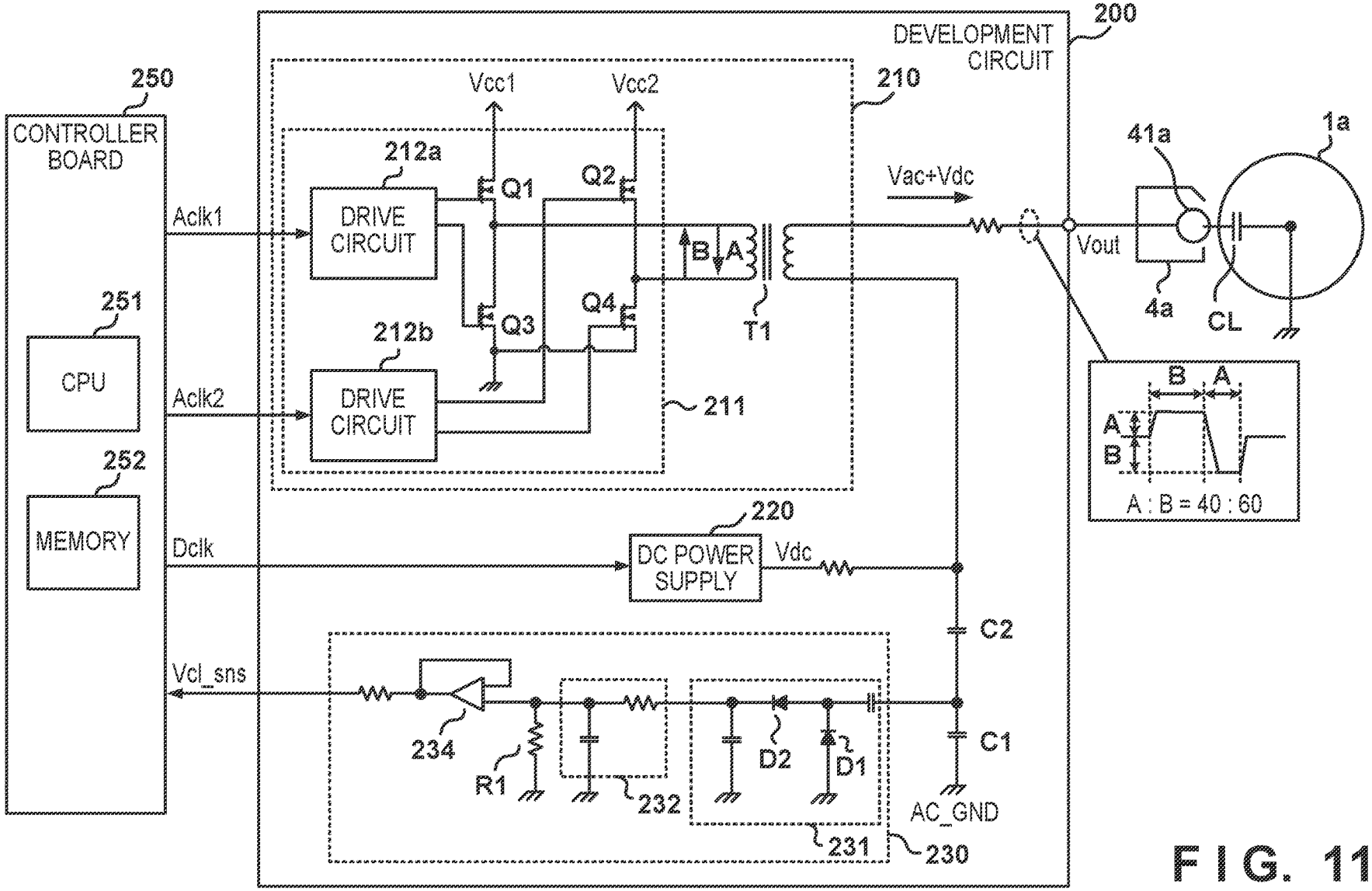
FIG. 11 is a diagram for describing a controller and a power supply circuit.

FIG. 11 illustrates the AC power supply 210 in a case where the relationship between the positive amplitude and the negative amplitude of the AC voltage Vac is in a state of non-equilibrium. As illustrated in FIG. 11, in a case where the positive and negative amplitudes are in a state of non-equilibrium, a positive reference voltage Vcc1 and a negative reference voltage Vcc2 are necessary. The positive reference voltage Vcc1 is connected to a drain of the switching element Q1. The negative reference voltage Vcc2 is connected to a drain of the switching element Q2. In other words, the ratio between the positive reference voltage Vcc1 and the negative reference voltage Vcc2 is A:B. Note that the clock signal Aclk1 and the clock signal Aclk2 are adjusted such that the ratio between the duty ratio of the positive amplitude and the duty ratio of the negative amplitude equals B:A.

Alternatively, even in a case such as that illustrated in FIG. 2 where the shared reference voltage Vcc is used, a state of non-equilibrium can be achieved. By adjusting the duty ratio of the clock signal Aclk1 and the duty ratio of the clock signal Aclk2, a state of non-equilibrium for the positive and negative amplitudes may be achieved.

In the present example, the change pattern is determined on the basis of the control table 751 stored in advance in the memory 252. However, this is merely an example. In another example, a mathematical formula or a function may be used that uses the measurement result 752 of the detection signal Vcl_sns as an input and the change pattern, i.e., a combination of the plurality of setting values, as the output.

Technical Ideas Derived from Examples

Perspective 1

The photosensitive drum 1 is an example of an image carrier on which an electrostatic latent image is formed. The developing sleeve 41*a* is an example of a developing member disposed opposing the image carrier with a gap inbetween. The development circuit 200 is an example of a power supply circuit that applies, to the developing member, the development voltage Vout that adheres the developing agent carried on the developing member to the electrostatic latent image. The controller board 250 and the CPU 251 function as a control unit that controls the power supply circuit by supplying a control signal (for example, the clock signals Aclk1, Aclk2) to the power supply circuit. The control signal may includes a PWM signal of which cycle (period) is a predetermined cycle (period). The detection circuit 230 detects an electrical characteristic. "Electrical characteristic" is the electrostatic capacitance generated between the image carrier and the developing member caused by the gap or the current (AC developing current) caused by applying the development voltage to the developing member. The CPU 251 and the determining unit 702 may convert the electrical characteristic detected by the detection circuit to a change pattern of the duty ratio of the PWM signal, i.e. the duty ratio of the PWM signal. In other words, the CPU 251 and the determining unit 702 determines the change pattern of the duty ratio of the PWM signal on the basis of the detected electrical characteristic. The CPU 251 changes the duty ratio as time passes according to the determined change pattern and outputs the control signal to the power supply circuit. In this manner, by converting the electrical characteristic of the electrostatic capacitance CL and the like to a change pattern (driving pattern), the amount of time needed for the adjustment processing of the development voltage is reduced compared to known techniques.

The processor may determine the change pattern of the duty ratio of a predetermined period for a case where the control signal is formed by a PWM signal of a predetermined period. The processor may determine a change pattern of the duty ratio of the PWM signal. Further the processor may gradually change the duty ratio of the PWM signal during a predetermined period of time. The predetermined period of time starts at a time point when rising of an alternating component of the development voltage begins. The processor may gradually increase the duty ratio of the PWM signal.

The power supply circuit may include a bridge circuit including a plurality of switching elements. There is an operation section in which the switching element is on in order for a current to run in which the alternating current component of the development voltage corresponds to a first polarity. As illustrated in FIG. 6, the processor may gradually change the duty ratio of a predetermined period in a range (for example, sections 1 to 5 of Aclk1) from when the operation section starts to when a predetermined amount of time has elapsed.

Perspective 2

The memory 252 and the control table 751 are an example of a pattern storage unit (pattern memory) that stores in advance a change pattern of the duty ratio of the PWM signal and the electrical characteristic between the image carrier and the developing member associated together. The determining unit 702 reads out, from the pattern storage unit, a change pattern of the duty ratio of the PWM signal corresponding to the electrical characteristic detected by the detection circuit. In this manner, the change pattern may be determined on basis of the electrical characteristic detected by the detection circuit. Note that the control table 751 is generated via experiment or simulation and is stored in the ROM area of the memory 252 when the image forming apparatus 100 is shipped from the factory.

Perspective 3

As illustrated in FIG. 6, the control table 751 may associate a first change pattern with an electrical characteristic of a first range (for example, CL<170 pF) and store these. The control table 751 may associate a second change pattern with an electrical characteristic of a second range (for example, 170 pF=<CL<200 pF) and store these. The control table 751 may associate a third change pattern with an electrical characteristic of a third range (for example, 200 pF=<CL<230 pF) and store these. In a case where the electrical characteristic detected by the detection circuit belongs to the first range, the determining unit 702 outputs the first change pattern. The change pattern is determined to be the first change pattern by the determining unit 702. In a case where the electrical characteristic detected by the detection circuit belongs to the second range, the determining unit 702 outputs the second change pattern. In other words, the change pattern is determined to be the second change pattern by the determining unit 702. In a case where the electrical characteristic detected by the detection circuit belongs to the third range, the determining unit 702 outputs the third change pattern. In other words, the change pattern is determined to be the third change pattern by the determining unit 702. In this example, three ranges are used. However, the number of ranges is only required to be two or more.

Perspective 4

The determining unit 702 may function as a calculation unit that determines the change pattern by calculating the change pattern on basis of the electrical characteristic detected by the detection circuit. This conversion method is effective in a case where the calculation capability of the determining unit 702 is high and the storage capacity of the memory 252 is insufficient.

Perspective 5

The CPU 251 and the monitoring unit 704 function as a determination unit that determines whether or not a detection condition (for example, an event occurring) for an electrical characteristic has been satisfied. The memory 252 functions as a characteristic storage unit that stores an electrical characteristic (for example, the measurement result 752) detected by the detection circuit in a case the detection condition is satisfied. The determining unit 702 determines the change pattern on the basis of the electrical characteristic stored in the characteristic storage unit. Each time image formation is executed, when an electrical characteristic is detected, the user waiting time is increased. Thus, by using an electrical characteristic detected in advance, user waiting time is decreased.

Perspectives 6 and 7

The detection condition may be the occurrence of an event of an image forming apparatus likely causing a difference between the electrical characteristic stored in the characteristic storage unit and the electrical characteristic between the developing member and the image carrier to be equal to or greater than a predetermined value. As described with reference to FIG. 6, the predetermined value may be 30 pF, for example. In other words, the predetermined value may not match the width of the ranges in the control table 751. The event may be that the developing member (the developing device 4*a*) has been replaced. The event may be that the image forming apparatus 100 has been supplied with power from a commercial power supply and has activated. The event may be that the number of sheets of images formed by the image forming apparatus since the detection condition was previously satisfied is equal to or greater than a predetermined number. The predetermined number of sheets may be 1000, for example.

Perspectives 8 and 9

The development circuit 200 functioning as a power supply circuit may include the DC power supply 220 that generates a DC voltage and an AC power supply 210 that generates an AC voltage, superimposes the AC voltage on the DC voltage, and outputs this as the development voltage. The AC power supply 210 generates an AC voltage with an amplitude corresponding to the duty ratio of the PWM signal. The period Tp of the control signal may be from 1/30 to 1/10 of the period T of the AC voltage.

Perspective 10

The statistical unit 703 functions as a statistical unit that obtains statistical values of a plurality of electrical characteristics detected by the detection circuit. The determining unit 702 may be configured to determine the change pattern on the basis of a statistical value (for example, the average value).

Perspective 11

The CPU 251 and the sampling circuit 721 may be configured to sample the electrical characteristic output from the detection circuit for each predetermined sampling period. The predetermined sampling period may be shorter than the AC voltage Vac period T and longer than the control signal period Tp, for example.

Perspective 12, 13

The AC power supply 210 includes the primary side circuit 211 and the transformer T1 with a primary winding wire connected to the primary side circuit 211 and a secondary winding wire that outputs the AC voltage. The primary side circuit 211 includes a full bridge circuit, a half bridge circuit, or a push-pull circuit that is supplied with the control signal. In a case where the AC power supply 210 includes a full bridge circuit, the full bridge circuit may include the following circuit elements. The drive circuit 212*a* is an example of a first drive circuit that is supplied with a first drive signal of the control signal and operates. The drive circuit 212*b* is an example of a second drive circuit that is supplied with a second drive signal of the control signal and operates. As illustrated in FIG. 2, the switching elements Q1, Q3 are examples of a first switching element and a third switching element that are driven by the first drive circuit. The switching elements Q2, Q4 are examples of a second switching element and a fourth switching element that are driven by the second drive circuit. The drain of the first switching element may have a first reference voltage (for example, Vcc, Vcc1) applied to it. The gate of the first switching element may be connected to the first drive circuit. The source of the first switching element may be connected to one end of the primary winding wire of the transformer T1 and the drain of the third switching element. The gate of the third switching element may be connected to the first drive circuit. The source of the third switching element may be connected to the ground. The drain of the second switching element may have a second reference voltage (for example, Vcc, Vcc2) applied to it. The gate of the second switching element may be connected to the second drive circuit. The source of the second switching element may be connected to the other end of the primary winding wire of the transformer T1 and the drain of the fourth switching element. The gate of the fourth switching element may be connected to the second drive circuit. The source of the fourth switching element may be connected to the ground. In a case where the first switching element is on, the third switching element is off, the second switching element is off, and the fourth switching element is on, the polarity of the AC voltage Vac is a first polarity (for example, positive). In a case where the first switching element is off, the third switching element is on, the second switching element is on, and the fourth switching element is off, the polarity of the AC voltage Vac is a second polarity (for example, negative).

Perspectives 14 to 17

The detection circuit 230 may include a voltage divider circuit (for example, the capacitor C1 and the like) that divides the development voltage. The detection circuit 230 may include a hold circuit (the peak hold circuit 231) that holds a peak-to-peak value of the output voltage of the divider circuit and outputs the peak-to-peak value to the control unit. The low-pass filter 232 that removes a high frequency component included in the peak-to-peak value may be provided between the hold circuit and the control unit (for example, the controller board 250). A high frequency component is caused by an overshoot in the development voltage Vout. In other words, by providing the low-pass filter 232, the electrostatic capacitance CL can be more accurately measured. The voltage follower circuit 234 that performs impedance conversion may be connected between the low-pass filter 232 and the control unit. This allows even a small detection signal Vcl_sns to be detected with high accuracy.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-126727, filed Jul. 27, 2020 which is hereby incorporated by reference herein in its entirety.

What is claimed is:

1. An image forming apparatus, comprising:

an image carrier on which an electrostatic latent image is formed;

a developing member disposed opposing the image carrier with a gap inbetween;

a power supply circuit that applies, to the developing member, a development voltage that adheres a developing agent carried on the developing member to the electrostatic latent image;

a processor that controls the power supply circuit by supplying a control signal to the power supply circuit, the control signal including a Pulse Width Modulation (PWM) signal having a predetermined period; and a detection circuit that detects an electrical characteristic associated with the developing member, the electrical characteristic being, correlated with an electrostatic capacitance caused by the gap between the image carrier and the developing member by applying the development voltage to the developing member, wherein the processor is configured to:

determine a change pattern of a duty ratio of the PWM signal on the basis of the electrical characteristic detected by the detection circuit, and output the control signal to the power supply circuit while changing the duty ratio of the PWM signal on the basis of the determined change pattern.

2. The image forming apparatus according to claim 1, wherein the processor is configured to gradually change the duty ratio of the PWM signal during a predetermined period of time starting at a time point when rising of an alternating component of the development voltage begins.

3. The image forming apparatus according to claim 2, wherein the processor is configured to gradually increase the duty ratio of the PWM signal.

4. The image forming apparatus according to claim 1, further comprising a pattern memory that stores in advance the change pattern of the duty ratio of the PWM signal and an electrical characteristic between the image carrier and the developing member associated together, wherein the processor is configured to determine the change pattern by reading out, from the pattern memory, the change pattern of the duty ratio of the PWM signal corresponding to the electrical characteristic detected by the detection circuit.

5. The image forming apparatus according to claim 4, wherein the pattern memory is configured to store:

a first change pattern associated with an electrical characteristic of a first range;

a second change pattern associated with an electrical characteristic of a second range; and a third change pattern associated with an electrical characteristic of a third range, and the processor is configured to:

in a case where the electrical characteristic detected by the detection circuit belongs in the first range, determine the change pattern of the duty ratio to be the first change pattern;

in a case where the electrical characteristic detected by the detection circuit belongs in the second range, determine the change pattern of the duty ratio to be the second change pattern; and in a case where the electrical characteristic detected by the detection circuit belongs in the third range, determine the change pattern of the duty ratio to be the third change pattern.

6. The image forming apparatus according to claim 1, wherein the processor is configured to determine the change pattern by calculating the change pattern from the electrical characteristic detected by the detection circuit.

7. The image forming apparatus according to claim 1, further comprising a characteristic memory that stores the electrical characteristic detected by the detection circuit in a case where a detection condition of the electrical characteristic is satisfied, wherein the processor is configured to determine whether or not the detection condition is satisfied and determines the change pattern on the basis of the electrical characteristic stored in the characteristic memory.

8. The image forming apparatus according to claim 7, wherein the detection condition is an occurrence of an event of the image forming apparatus likely causing a difference between the electrical characteristic stored in the characteristic memory and the electrical characteristic between the developing member and the image carrier to be equal to or greater than a predetermined value.

9. The image forming apparatus according to claim 8, wherein the event is at least one of:

the developing member being replaced, the image forming apparatus being supplied with power from a commercial power supply and activating, or a number of sheets of images formed by the image forming apparatus since satisfaction of the detection condition being equal to or greater than a predetermined number.

10. The image forming apparatus according to claim 1, wherein the power supply circuit includes:

a DC power supply that generates a DC voltage, and an AC power supply that generates an AC voltage and outputs the development voltage obtained by superimposing the AC voltage on the DC voltage; and the AC power supply generates an AC voltage with an amplitude corresponding to the duty ratio of the PWM signal.

11. The image forming apparatus according to claim 10, wherein a period of the PWM signal is from 1/30 to 1/10 of a period of the AC voltage.

12. The image forming apparatus according to claim 11, wherein the processor is configured to:

obtain a statistical value of a plurality of electrical characteristics detected by the detection circuit and determine the change pattern on the basis of the statistical value.

13. The image forming apparatus according to claim 12, wherein the processor is configured to:

sample the electrical characteristics output from the detection circuit for each predetermined sampling period; and the predetermined sampling period is shorter than the period of the AC voltage and longer than the period of the PWM signal.

14. The image forming apparatus according to claim 10, wherein the AC power supply includes:

a primary side circuit including a full bridge circuit, a half bridge circuit, or a push-pull circuit supplied with the control signal, and a transformer that has a primary winding wire connected to the primary side circuit, and outputs the AC voltage to a secondary winding wire.

15. The image forming apparatus according to claim 14, wherein the AC power supply includes the full bridge circuit;

the full bridge circuit includes:

a first drive circuit that operates be being supplied with a first drive signal as the control signal, a second drive circuit that operates by being supplied with a second drive signal as the control signal, a first switching element and a third switching element driven by the first drive circuit, and a second switching element and a fourth switching element driven by the second drive circuit;

wherein a drain of the first switching element has a first reference voltage applied to it;

a gate of the first switching element is connected to the first drive circuit;

a source of the first switching element is connected to one end of the primary winding wire of the transformer and a drain of the third switching element;

a gate of the third switching element is connected to the first drive circuit;

a source of the third switching element is connected to a ground;

a drain of the second switching element has a second reference voltage applied to it;

a gate of the second switching element is connected to the second drive circuit;

a source of the second switching element is connected to another end of the primary winding wire of the transformer and a drain of the fourth switching element;

a gate of the fourth switching element is connected to the second drive circuit;

a source of the fourth switching element is connected to a ground;

in a case where the first switching element is on, the third switching element is off, the second switching element is off, and the fourth switching element is on, a polarity of the AC voltage is a first polarity; and in a case where the first switching element is off, the third switching element is on, the second switching element is on, and the fourth switching element is off, a polarity of the AC voltage is a second polarity.

16. The image forming apparatus according to claim 1, wherein the detection circuit includes:

a voltage divider circuit that divides the development voltage, and a hold circuit that holds a peak-to-peak value of an output voltage of the voltage divider circuit and outputs the peak-to-peak value to the processor.

17. The image forming apparatus according to claim 16, further comprising a low-pass filter that removes a high frequency component included in the peak-to-peak value output from the hold circuit.

18. The image forming apparatus according to claim 17, wherein the high frequency component is caused by an overshoot in the development voltage.

19. The image forming apparatus according to claim 17, further comprising a voltage follower circuit that performs impedance conversion between the low-pass filter and the processor.

* * * * *